United States Patent [19]

Burt

[11] 4,060,482

[45] Nov. 29, 1977

[54] METHOD OF AND APPARATUS FOR SEPARATING FRACTIONS OF DIFFERENT DENSITY CONTAINED IN ORES OR OTHER SOLID MATERIALS

[75] Inventor: Richard Owen Burt, Camborne, England

[73] Assignee: Bartles (Carn Brea) Limited, United Kingdom

[21] Appl. No.: 622,722

[22] Filed: Oct. 15, 1975

[30] Foreign Application Priority Data

Oct. 18, 1974 United Kingdom ..... 45230/74

[51] Int. Cl.[2] ..... B03B 5/08

[52] U.S. Cl. ..... 209/432; 209/497; 209/500

[58] Field of Search ..... 209/432, 429, 431, 428, 209/470, 114, 430, 433, 424, 426, 436, 441, 497, 500

[56] References Cited

U.S. PATENT DOCUMENTS

| | | | |
|---|---|---|---|
| 458,069 | 8/1891 | Rowe | 209/432 |
| 470,781 | 3/1892 | Cudner | 209/429 |
| 763,197 | 6/1904 | Monell | 209/432 |
| 885,692 | 4/1908 | Evans et al. | 209/432 |
| 1,108,186 | 8/1914 | King | 209/432 |
| 1,114,935 | 10/1914 | Sutton et al. | 209/114 |
| 1,781,971 | 11/1930 | Bielenberg | 209/429 X |
| 1,934,812 | 11/1933 | Mitchell | 209/429 |
| 3,744,632 | 7/1973 | Mozley | 209/433 |
| 3,904,517 | 9/1975 | Wilson | 209/441 |

*Primary Examiner*—Frank W. Lutter
*Assistant Examiner*—Ralph J. Hill
*Attorney, Agent, or Firm*—Buell, Blenko & Ziesenheim

[57] ABSTRACT

Fractions of different densities contained in an ore or other solid material are separated by directing the solid material in a liquid suspension on to a surface of an endless belt, moving in the direction of its length and inclined transversely to its direction of motion, along a first part of the length of a higher portion of the belt and subjecting said moving surface of the belt to a shaking motion so that lighter fractions are separated from the material and flow off a lower side edge of the belt into a receptacle. Washing liquid is directed on to the moving surface from another part of the length of the higher portion of the belt that is downstream of the first part so that washing liquid flows transversely across the shaking, moving surface to separate middling fractions from the material and carry them off the lower side edge of the belt into a second receptacle. Heavier fractions that remain on the moving surface are discharged over the downstream end of the moving surface of the endless belt into a third receptacle. The middling fractions collected in the second receptacle are re-treated by redirecting them on to the belt along a part of the higher portion of the belt between the positions where the material and the washing liquid are directed on to the belt, the heavier of the middling fractions being discharged over the downstream end of the moving surface into the third receptacle. Preferably the higher portion of the moving surface of the belt extends lengthwise along or adjacent the central longitudinal axis of the surface thereby providing for two separation processes to be effected concurrently on a single endless belt.

25 Claims, 6 Drawing Figures

Figure 1:
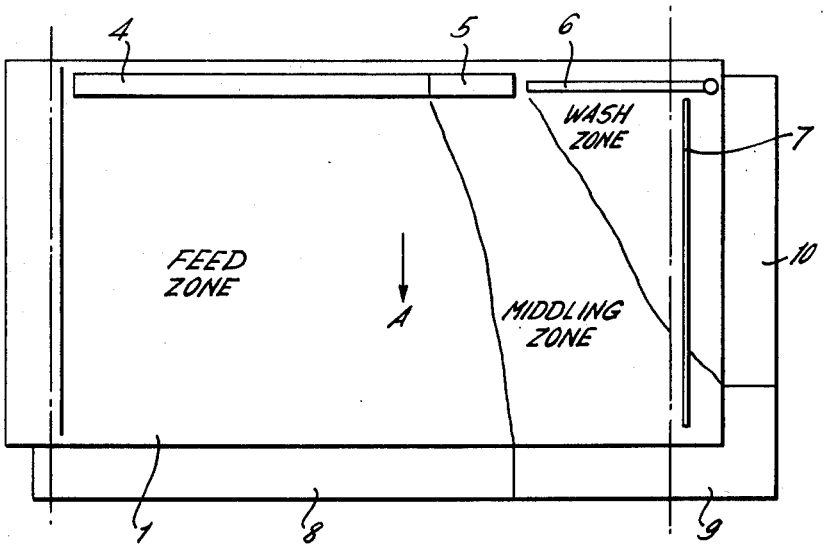

METHOD OF AND APPARATUS FOR SEPARATING FRACTIONS OF DIFFERENT DENSITY CONTAINED IN ORES OR OTHER SOLID MATERIALS

This invention relates to the separation of fractions of different densities contained in ores or other solid materials.

The invention is particularly concerned with a known technique of separating fractions of different densities contained in an ore in which the heavier fractions in a liquid suspension of an ore are separated from the lighter fractions by directing the ore on to a surface of an inclined, moving endless belt as washing liquid is caused to flow down the belt and subjecting the belt to a shaking motion, the lighter fractions being washed free from the suspension so formed and the heavier fractions being retained on and carried upwardly by the belt.

According to the present invention an improved method of separating fractions of different densities contained in an ore or other solid material comprises directing the solid material in a liquid suspension on to a surface of an endless belt, moving in the direction of its length and inclined transversely of its direction of motion, along a first part of the length of a higher portion of the belt and subjecting said moving surface of the belt to a shaking motion so that lighter fractions are separated from the material and flow off a lower side edge of the belt into a receptacle; directing washing liquid on to said moving surface from another part of the length of said higher portion of the belt that is downstream of said first part so that washing liquid flows transversely across said shaking, moving surface to separate less light fractions (hereinafter referred to as "middling fractions") from the material and carry them off the lower side edge of the belt into a second receptacle; discharging heavier fractions of the material that remain on said shaking, moving surface over the downstream end of said moving surface of the endless belt into a third receptacle retreating the middling fractions collected in the second receptacle by redirecting them on to the moving surface of the endless belt along a part of the higher portion of the belt that lies between the first part, along which the material in a liquid suspension is directed on to the moving surface, and the other part, along which washing liquid is directed on to the moving surface to flow transversely across the moving surface; and discharging the heavier of the middling fractions over the higher part of the downstream end of the moving surface into said third receptacle.

Preferably upstream of the downstream end of the moving surface of the endless belt, in the region where washing liquid (usually water) is directed on to the moving surface to flow transversely across the moving surface, the suspension of material is subjected to a further washing liquid which is directed downwardly on to the moving surface across the width of the belt. This further washing liquid is preferably supplied as a plurality of separate streams spaced transversely across the width of the belt, for instance in a known drop-wise fashion from above the moving surface at a number of transversely spaced positions.

The heavier fractions that are discharged over the higher portion of the downstream end of the moving surface of the belt are substantially cleaner than the heavier fractions that are discharged over the lower portion of the downstream end of the moving surface and, for this reason, preferably the less clean heavier fractions are collected separately from the clean heavier fractions and may, if desired, be collected in said second receptacle with the middling fractions.

The less clean heavier fractions are preferably also re-treated by re-directing them on to the moving surface of the endless belt along a part of the higher portion of the belt that lies between the first part, along which the material is directed on to the moving surface, and the other part, along which washing liquid is directed on to the moving surface. In this way, the less clean heavier fractions will be subjected to a second cleaning operation and will be discharged over the higher part of the downstream end of the moving surface; the heavier of the middling fractions will also be discharged over the higher part of the downstream end of the moving surface.

Preferably, the material will be fed to the moving surface in the form of a suspension, containing solids in the range 15% – 35%.

The optimum angle of transverse inclination of the moving surface of the endless belt, the optimum linear speed of the moving surface, the optimum orbital speed of an out-of-balance rotatably driven shaft effecting orbital shaking motion, the optimum rate of transverse flow of washing liquid and the optimum rate of transverse flow of feed suspension will depend on the ore or other solid material being treated but, by way of example, for an ore comprising fine tin in its mineral form cassiterite, and gangue minerals including quartz, the angle of transverse inclination of the moving surface of the endless belt lies in the range $1\frac{1}{2}°$ to $3\frac{1}{2}°$, for example 2°; the linear speed of the moving surface of the belt preferably lies in the range 3 mm/sec to 8 mm/sec, for example 4 mm/sec; the orbital speed of the out-of-balance rotatably driven shaft preferably lies in the range 250 to 400 r.p.m., for example 320 r.p.m; the rate of transverse flow of washing liquid is preferably in the range 25 ml/sec/m length of the moving surface to 200 ml/sec/m length of the moving surface, for example 100 ml/sec/m length of the moving surface; and the rate of transverse flow of feed suspension is preferably in the range 75 ml/sec/m length of the moving surface to 250 ml/sec/m length of the moving surface, for example 100 ml/sec/m length of the moving surface.

The invention includes apparatus for use in the method described above, which apparatus comprises (a) an endless belt for supporting on its uppermost surface a liquid suspension of said material, the belt being so arranged that said uppermost surface is inclined, in a direction transversely of its length, downwardly towards at least one of its side edges; (b) means for driving the belt in the direction of its length; (c) means along and upstream of a higher portion of said transversely inclined uppermost surface for directing solid material in suspension on to said surface; (d) means, downstream of said material-feed means, for directing washing liquid on to said surface along a higher portion of the surface so that washing liquid will flow transversely across said uppermost surface towards said side edge or side edges; (e) means for imparting a shaking motion to said uppermost surface to facilitate separation of fractions; (f) separate receptacles along said side edge or side edges of the belt for separate collection of light and middling fractions; (g) a separate receptacle at the downstream end of the belt for collection of heavier fractions; and, (h) alongside the higher portion of the uppermost surface between said material-feeding means and the means for directing washing liquid on to the surface, means for directing middling fractions, and if desired, less clean fractions on to said surface.

The higher portion of the uppermost surface of the endless belt may be one of the side edges of said surface or it may be a portion of said surface extending lengthwise between the side edges of the surface, preferably along or adjacent the central longitudinal axis of the surface, thereby providing for two separation processes to be effected concurrently on a single endless belt.

Means for directing a liquid suspension of an ore or other solid material on to the uppermost surface will be positioned alongside an upstream part of said higher portion of said surface and/or at the higher portion of the upstream end of the uppermost surface of the belt.

A further receptacle may be provided at the lower part of the downstream end of the belt for collection of less clean heavier fractions, or the receptacle for the middling fractions may be of such a shape and size and may be so positioned as also to collect the less clean heavier fractions.

Preferably the apparatus also includes, upstream of the downstream end of the belt, means for directing washing liquid downwardly on to the uppermost surface of the belt across the width of the belt. This washing liquid supply means is preferably of such a form as to direct a plurality of transversely spaced streams of washing liquid on to the surface and, in a preferred embodiment, comprises a plurality of known drop-forming devices.

The means for imparting a shaking motion to the uppermost surface of the belt is preferably of such a form as to impart an orbital shaking motion and is preferably so located as to impart the shaking motion to the regions of the belt to which middling fractions are fed and transversely across which washing liquid will flow. The orbital shaking motion may be provided in any one of several ways but it is preferred for the endless belt assembly to be mounted in a sub-frame which is suspended from a fixed frame by suspension wires and for the shaking motion to be provided, in a known manner, by an out-of-balance rotatably driven shaft mounted on the sub-frame. Preferably the speed at which the shaft is rotatably driven is adjustable and, in a preferred embodiment, the shaft is driven by an infinitely variable D.C. Motor.

The endless belt may be of conventional form passing around two rollers spaced lengthwise with respect to the belt, at least one of which rollers is a driving roller, preferably capable of driving the endless belt at any speed within a limited range. The transverse inclination of the belt may be provided by rollers which are arranged with their axes substantially horizontal and whose external diameters decrease towards one or each end of the rollers and/or by the angle which the axis of each roller makes with the horizontal and/or by the lengths of the wires by which the sub-frame is suspended from the fixed frame and/or by means beneath the belt adjacent each roller for raising or lowering the higher portion of the uppermost surface of the belt. Preferably the angles of transverse inclination of the uppermost surface of the belt at the upstream and downstream ends of the belt are independently adjustable so that, if desired, the angle of inclination of the belt at the downstream end of the belt may be arranged to differ from the angle of inclination of the belt at the upstream end of the belt. Preferably, also, the arrangement is such that adjustment of the angle of inclination of the belt at an end of the belt can be effected during operation of the apparatus.

In the case where each roller is arranged with its axis substantially horizontal and has an external diameter that decreases smoothly towards one or each end of the roller, each roller may comprise an elongate core and a separately formed sleeve that fits on the core and has an external diameter that decreases smoothly towards one or each end of the sleeve.

In the case where the transverse inclination of the belt is determined by the angle which the axis of each roller makes with the horizontal, each roller may be of uniform cross-section throughout its length and be so supported that the angle its axis makes with the horizontal is adjustable, e.g. by adjusting the lengths of the wires along at least one side of the fixed frame from which the sub-frame is suspended, thereby to provide the higher portion of the uppermost surface of the belt along one of its side edges.

In the case where the higher portion of the uppermost surface of the belt extends between the side edges of the surface, each roller may have an external diameter which decreases smoothly towards each end of the roller and, adjacent each roller, there may be provided beneath the belt an adjustable wedge arrangement or other adjustable device for effectively raising or lowering the part of a sub-frame over which the higher porton of the belt travels. In alternative embodiments for use in the case where the higher portion of the uppermost surface of the belt extends between said edges of the surface, each roller may be in two separately formed parts connected end to end at a point below the higher portion of the uppermost surface, the connection between the two parts of the roller being of such a form that the angle subtended by the two parts of the roller can be adjusted to any angle within a limited range.

Figure 2:
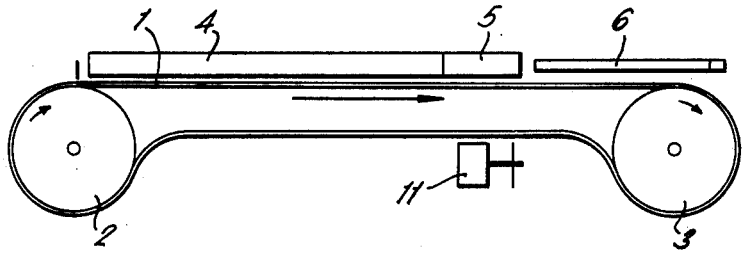
Figure 3:
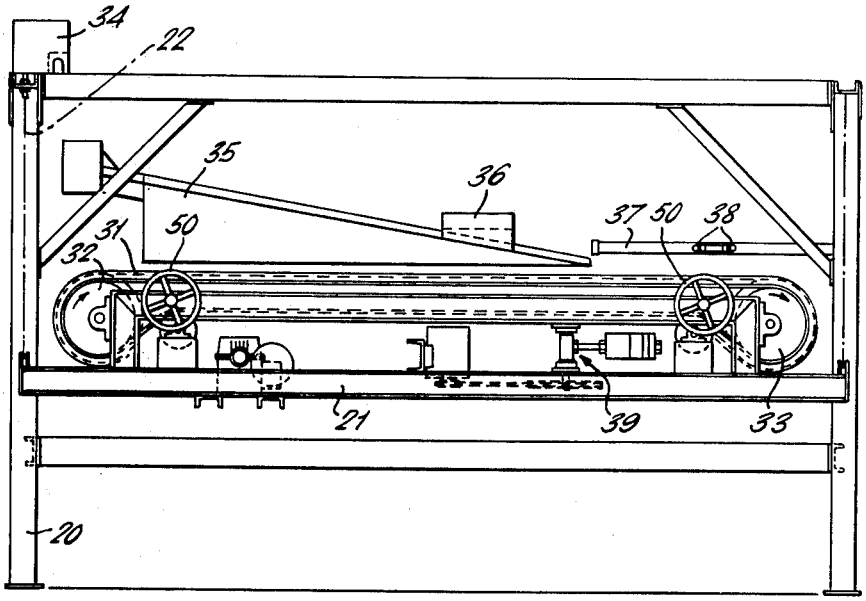
Figure 4:
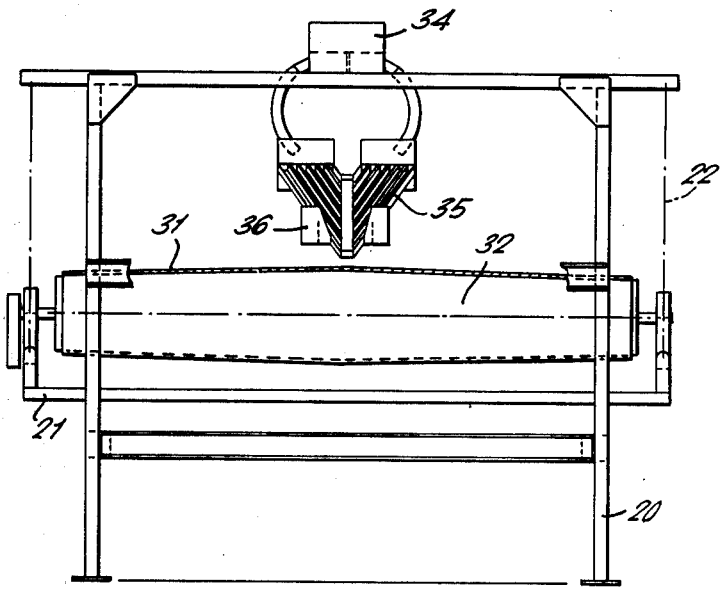
Figure 5:
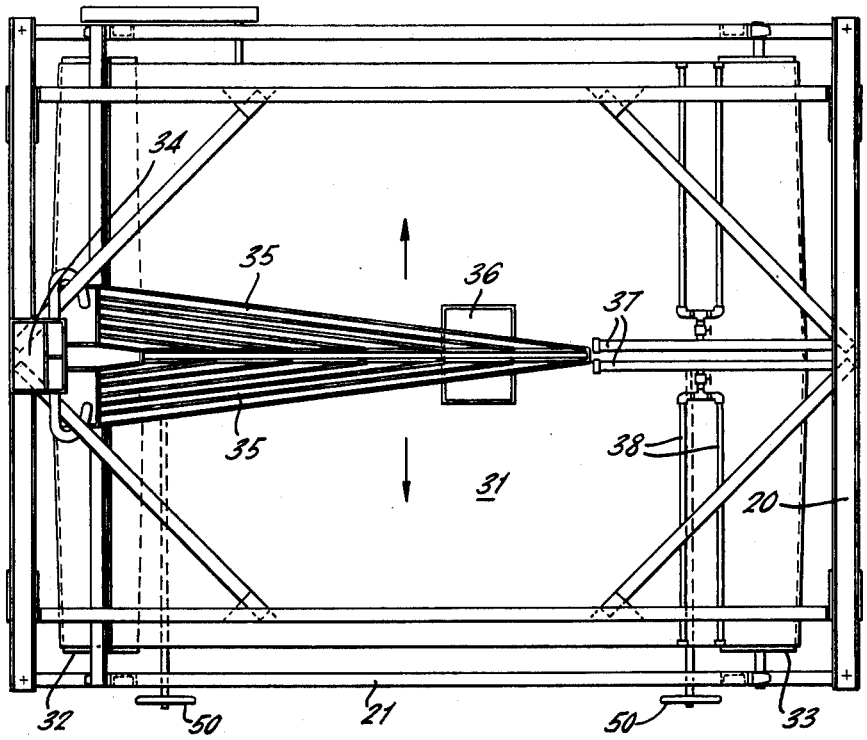
Figure 6:
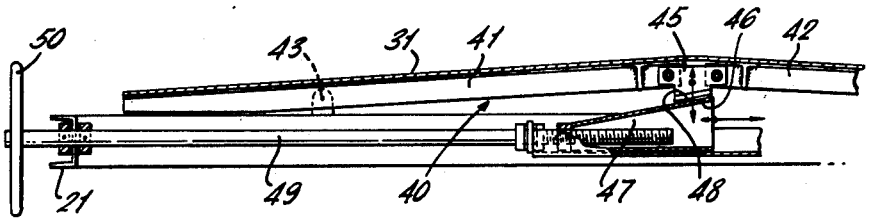

The invention is further illustrated by a description, by way of example, by two forms of apparatus for separating fractions of different densities contained in an ore, with reference to the accompanying drawings, in which:

FIGS. 1 and 2, respectively, are diagrammatic plan and side views of a first and simple form of apparatus;

FIG. 3 is a side view of a second and preferred form of apparatus;

FIGS. 4 and 5, respectively, are end and plan views of the preferred apparatus shown in FIG. 3, and FIG. 6 is a fragmental transverse cross-sectional view of the preferred apparatus illustrating the device for adjusting the angle of transverse inclination of each portion of the belt.

Referring to FIGS. 1 and 2, the first and simple form of apparatus comprises an endless belt 1 which passes around a drive roller 2 and an idler roller 3 that are spaced lengthwise with respect to the belt. The endless belt assembly is mounted in a sub-frame (not shown) which is suspended from a fixed frame (not shown) by four suspension wires whose lengths can be adjusted. Each of the rollers 2 and 3 has an external diameter that decreases smoothly from one end of the roller to the other and the rollers are so arranged that the endless belt 1 is inclined transversely to its length in a downward direction as indicated by Arrow A. Positioned above the higher portion of the belt 1 adjacent its side edge is a feed device 4 for the ore, a feed device 5 for middling fractions that have been separated from the ore and a device 6 for causing water to flow transversely across the belt in the direction of Arrow A. A device 7 for directing water drop-wise on to the uppermost surface of the belt 1 at positions spaced transversely across the belt is mounted above the belt adjacent the downstream end of the belt. Below the lower side edge of the belt 1 is a receptacle 8 for collecting lighter fractions of the ore and a receptacle 9 for collecting middling fractions; the receptacle 9 also extends below a lower part of the downstream end of the belt so that it will also collect less clean heavier fractions. A receptacle 10 is provided beneath the downstream end of the belt at its upper part for collecting clean heavier fractions. Beneath the belt 1 in the regions where middling fractions and water are directed on to the uppermost surface of the belt is a device 11 for imparting orbital shaking motion to the uppermost surface of the belt.

In operation, ore in the form of a suspension containing solids in the range 15% to 35% is fed from the device 4 on to the upstream end of the uppermost surface of the transversely inclined belt 1 as the uppermost surface is travelling from the roller 2 to the roller 3 and is continuously subjected to an orbital shaking motion by the device 11. At the same time water from the device 6 is caused to flow continuously across the uppermost surface of the belt 1 and water is directed drop-wise from the device 7 on to the uppermost surface at positions spaced transversely across the belt. Lighter fractions of the ore flow off the lower side edge of the transversely inclined belt 1 and are collected in the receptacle 8 and middling fractions of the ore are washed off the lower side edge of the belt and are collected in the receptacle 9. Heavier fractions of the ore are discharged over the downstream end of the belt 1, the cleaner heavier fractions being discharged over the higher portion of the downstream end and being collected in the receptacle 10 and less clean heavier fractions being discharged over the lower portion of the downstream end and being collected in the receptacle 9. The middling fractions and less clean heavier fractions are re-treated by transferring them to the feed device 5 and by re-directing them from this feed device on to the uppermost surface of the belt. The less clean heavier fractions are thereby subjected to a second cleaning operation and are discharged over the higher part of the downstream end of the belt into the receptacle 10; the heavier of the re-treated middling fractions will also be discharged over the higher part of the downstream end of the belt into the receptacle 10.

The second, and preferred, form of apparatus shown in FIGS. 3 to 6 is designed to provide for two separation processes to be effected concurrently on a single endless belt. The apparatus comprises a fixed frame 20 from which a subframe 21 is suspended by four suspension wires 22. Mounted on the sub-frame 21 is an endless belt assembly comprising an endless belt 31 which passes around a drive roller 32 and an idler roller 33 spaced lengthwise with respect to the belt. Each roller 32, 33 has an external diameter that decreases smoothly from a position mid-way between its ends towards each end of the roller so that the uppermost surface of the belt 31 has a higher portion that extends along or adjacent the central longitudinal axis of the surface and the uppermost surface of the belt is inclined transversely to its length downwards from said higher portion towards each of its side edges. Mounted on the fixed frame 20 above the central higher portion of the uppermost surface of the belt 31 is a container 34 for feeding ore in the form of a suspension into two feed wells 35 which direct the ore on to the uppermost surface of the belt on opposite sides of the higher portion of the surface to feed each of the two separation processes. Each of the feed wells 35 has, part way along its length, a container 36 into which middling fractions separated from the ore can be transferred for retreatment. Extending above the uppermost surface of the belt 31, between the feed wells 35 and the downstream end of the belt, are two pipes 37 each of which has a plurality of apertures mutually spaced along its length and which is employed to direct a stream of water to flow transversely across one of the two transversely inclined portions of the belt. Pairs of pipes 38 are mounted above and extend transversely across the inclined portions of the uppermost surface of the belt 31 and each of these pipes has a plurality of apertures mutually spaced along its length for directing separate streams of water downwardly on to the uppermost surface.

Mounted on the sub-frame 21 beneath the belt 31 in the regions where middling fractions and water are directed on to the uppermost region of the belt is an out-of-balance rotatably driven shaft 39 by means of which an orbital shaking motion can be imparted to the uppermost surface of the belt in a known manner. Between the rollers 32 and 33 the upper part of the belt 31 passes over a part 40 of the sub-frame 21 which is divided longitudinally into two separately formed parts 41 and 42 pivoted at 43 and pivotally interconnected adjacent each roller 32 and 33 by a link 45. Each link 45 has an inclined surface 46 which is engaged by the inclined surface 48 of a wedge member 47 mounted on a shaft 49 in such way that the shaft can be caused to rotate about its axis with respect to the wedge member. By rotating the shaft 49 by means of a hand wheel 50 at one end of the shaft, the wedge member 47 can be caused to move in either direction transversely to the longitudinal axis of the belt 31, to raise or lower the central higher portion of the uppermost surface of the belt. Thus, the angle of inclination of each inclined portion of the belt 31 can be adjusted at each end of belt and the angles of inclination at one end of the belt can be arranged to differ from the angles of inclination at the other end of the belt.

As in the apparatus shown in FIGS. 1 and 2, receptacles (not shown) are positioned below the side edges of the uppermost surface of the belt 31 and at the downstream end of the belt for collecting separated lighter, middling and heavier fractions of the ore.

The mode of operation of the apparatus shown in FIGS. 3 to 6 to effect two separation processes concurrently is substantially the same as that of the apparatus shown in FIGS. 1 and 2.

What I claim as my invention is:

1. A method of separating fractions of different densities contained in solid material which comprises directing the solid material in a liquid suspension on to a surface of an endless belt moving in the direction of its length and, inclined transversely to its direction of motion, along a first part of the length of a higher portion of the belt and subjecting said moving surface of the belt to a shaking motion so that lighter fractions are separated from the material and flow off a lower side edge of the belt into a receptacle; directing washing liquid on to said moving surface from another part of the length of said higher portion of the belt that is downstream of said first part so that the washing liquid flows transversely across said shaking, moving surface to separate middling fractions from the material and carry them off the lower side edge of the belt into a second receptacle; discharging heavier fractions of the material that remain on said shaking, moving surface over the downstream end of said moving surface of the endless belt into a third receptacle; retreating the middling fractions collected in the second receptacle by redirecting them on to the moving surface of the endless belt along a part of the higher portion of the belt that lies between the first part, along which the material in a liquid suspension is directed on to the moving surface, and the other part, along which washing liquid is directed on to the moving surface to flow transversely across the moving surface; and discharging the heavier of the middling fractions over the higher part of the downstream end of the moving surface into said third receptacle.

2. A method as claimed in claim 1, wherein heavier fractions that are discharged over the lower portion of the downstream end of the moving surface of the belt are collected separately from the heavier fractions that are discharged over the higher portion of the downstream end of the moving surface.

3. A method as claimed in claim 1, wherein heavier fractions that are discharged over the lower portion of the downstream end of the moving surface of the belt are collected in said second receptacle with, and treated as, middling fractions.

4. A method as claimed in claim 1, wherein upstream of the downstream end of the moving surface of the endless belt, in the region where washing liquid is directed on to the moving surface to flow transversely across the moving surface, the suspension of material is subjected to a further washing liquid which is directed downwardly on to the moving surface across the width of the belt.

5. A method as claimed in claim 4, wherein the further washing liquid is supplied as a plurality of downwardly directed separate streams spaced transversely across the width of the belt.

6. A method as claimed in claim 1, wherein the suspension of material fed to the moving surface contains solids in the range 15% to 35%.

7. A method as claimed in claim 1, wherein the material is also directed on to the moving surface of the endless belt along a higher portion of the upstream end of the belt.

8. A method as claimed in claim 1, wherein the shaking motion is an orbital shaking motion.

9. A method as claimed in claim 8, wherein the orbital shaking motion is effected by means of an out-of-balance rotatably driven shaft which is driven at an orbital speed in the range 250 to 400 r.p.m.

10. A method as claimed in claim 1, wherein the angle of transverse inclination of the moving surface of the endless belt lies in the range $1\frac{1}{2}°$ to $3\frac{1}{2}°$.

11. Apparatus for use in separating fractions of different densities contained in solid material comprising (a) an endless belt for supporting on its uppermost surface a liquid suspension of said material, the belt being so arranged that said uppermost surface is inclined, in a direction transversely of its length, downwardly towards at least one of its side edges; (b) means for driving the belt in the direction of its length; (c) means along and upstream of a higher portion of said transversely inclined uppermost surface for directing solid material in suspension on to said surface; (d) means downstream of said material-feed means, for directing washing liquid on to said uppermost surface along a higher portion of the surface so that washing liquid will flow transversely across said uppermost surface towards said side edge or side edges; (e) means for imparting a shaking motion to said uppermost surface to facilitate separation of the fractions; (f) separate receptacles along said side edge or side edges of the belt for separate collection of light and middling fractions; (g) a separate receptacle at the downstream end of the belt for collection of heavier fractions; and, (h) alongside the higher portion of the uppermost surface between said material-feeding means and the means for directing washing liquid on to the surface, means for directing middling fractions and, if desired, less clean fractions on to said surface.

12. Apparatus as claimed in claim 11, wherein the higher portion of the uppermost surface of the belt extends lengthwise along or adjacent the central longitudinal axis of the surface.

13. Apparatus as claimed in claim 11, wherein means for directing in a liquid suspension of solid material on to the uppermost surface of the belt is positioned alongside an upstream part of said higher portion of said surface.

14. Apparatus as claimed in claim 11, wherein the receptacle for collecting the middling fractions is of such a shape and size and is so positioned as also to collect the less clean heavier fractions from the lower portion of the downstream end of the uppermost surface of the belt.

15. Apparatus as claimed in claim 11, wherein a further receptacle is provided at the lower part of the downstream end of the belt for collection of less clean heavier fractions.

16. Apparatus as claimed in claim 11, wherein means is provided, upstream of the downstream end of the belt, for directing washing liquid downwardly on to the uppermost surface of the belt across the width of the belt.

17. Apparatus as claimed in claim 16, wherein the washing liquid supply means is of such a form as to direct a plurality of transversely spaced streams of washing liquid downwardly on to the uppermost surface of the belt.

18. Apparatus as claimed in claim 11, wherein the means for imparting a shaking motion to the uppermost surface of the belt is of such a form as to impart an orbital shaking motion.

19. Apparatus as claimed in claim 18, wherein the endless belt assembly is mounted in a sub-frame which is suspended from a fixed frame by suspension wires and the means for imparting an orbital shaking motion to the uppermost surface of the belt comprises an out-of-balance rotatably driven shaft mounted on the sub-frame.

20. Apparatus as claimed in claim 11, wherein the endless belt passes around two rollers spaced lengthwise with respect to the belt, at least one of which rollers is a driving roller.

21. Apparatus as claimed in claim 20, wherein each roller is arranged with its axis substantially horizontal and has an external diameter that decreases smoothly towards at least one end of the roller to provide for the required transverse inclination of the belt.

22. Apparatus as claimed in claim 20, wherein each roller is of uniform transverse cross-section throughout its length and is so supported that the angle which the axis of the roller makes with the horizontal is adjustable to provide for the required transverse inclination of the belt.

23. Apparatus as claimed in claim 22, wherein the angles of transverse inclination of the uppermost surface of the belt at the upstream and downstream ends of the belt are independently adjustable.

24. Apparatus as claimed in claim 20, wherein means is provided beneath the belt adjacent each roller for adjusting the height of the higher portion of the uppermost surface of the belt.

25. Apparatus as claimed in claim 11, in which the endless belt assembly is mounted in a sub-frame which is suspended from a fixed frame by suspension wires, wherein the lengths of the suspension wires along at least one side of the fixed frame are adjustable.

* * * * *